US007824476B2

(12) United States Patent
Chung

(10) Patent No.: US 7,824,476 B2
(45) Date of Patent: Nov. 2, 2010

(54) HIGH SPEED TUNNEL FAN WITH ELECTROSTATIC FILTER

(76) Inventor: Jong Seung Chung, D-1202, The Sharp Starcity 227-7, Jayang-Dong, Gwangjin-Gu, Seoul 143-190 (KR)

( * ) Notice: Subject to any disclaimer, the term of this patent is extended or adjusted under 35 U.S.C. 154(b) by 310 days.

(21) Appl. No.: 12/039,104

(22) Filed: Feb. 28, 2008

(65) Prior Publication Data

US 2009/0056550 A1 Mar. 5, 2009

(30) Foreign Application Priority Data

Aug. 27, 2007 (KR) ..... 10-2007-0086312

(51) Int. Cl.
*B03C 3/10* (2006.01)
*B03C 3/36* (2006.01)

(52) U.S. Cl. ..... 96/63; 55/DIG. 38; 96/94; 96/97; 96/98; 96/100

(58) Field of Classification Search ..... 96/63, 96/68, 94–98; 55/DIG. 38
See application file for complete search history.

(56) References Cited

U.S. PATENT DOCUMENTS

| | | | | | |
|---|---|---|---|---|---|
| 1,396,811 | A * | 11/1921 | Chubb | | 95/77 |
| 3,722,183 | A * | 3/1973 | Gaylord | | 96/63 |
| 4,386,055 | A * | 5/1983 | McBride | | 422/186.18 |
| 5,277,703 | A * | 1/1994 | Sklenak et al. | | 95/77 |
| 5,380,355 | A * | 1/1995 | Brothers | | 96/64 |
| 5,667,565 | A * | 9/1997 | Gondar | | 96/60 |
| 5,779,769 | A * | 7/1998 | Jiang | | 96/55 |
| 6,203,600 | B1 * | 3/2001 | Loreth | | 96/40 |
| 6,398,852 | B1 * | 6/2002 | Loreth | | 96/63 |
| 2001/0029842 | A1 * | 10/2001 | Hoenig | | 96/63 |

FOREIGN PATENT DOCUMENTS

| | | | | |
|---|---|---|---|---|
| JP | 52-18266 A * | 2/1977 | | 96/94 |

* cited by examiner

*Primary Examiner*—Richard L Chiesa
(74) *Attorney, Agent, or Firm*—Rosenberg Klein & Lee

(57) ABSTRACT

A tunnel fan with an electrostatic filter is disclosed. The tunnel fan includes: a cylindrical shaped tunnel fan; and an electrostatic filter including a pipe assembly, the pipe assembly including a plurality of pipes arranged in parallel to form a cylindrical shape, each pipe having an electrostatic induction means for causing tiny dust to be collected by an induction voltage, wherein the electrostatic filter is coupled to a front or a rear of the tunnel fan.

19 Claims, 11 Drawing Sheets

HIGH SPEED TUNNEL FAN WITH ELECTROSTATIC FILTER

TECHNICAL FIELD

The present invention relates to a high speed tunnel fan such as a jet fan or a booster fan which is installed on a tunnel's ceiling to exhaust air to ventilate a tunnel. More particularly, the present invention relates to a high speed tunnel fan with an electrostatic filter which is coupled to a front or a rear thereof to collect contaminants such as dust or particles contained in air inhaled into or exhausted from the high speed tunnel fan, cleaning polluted air in a tunnel.

BACKGROUND ART

Due to advances in tunnel building technology, the number of tunnels is increased, and a tunnel is longer. As a tunnel is longer, it is more difficult to circulate air, and density of soot and smoke, contaminants and tiny dust generated by vehicles is higher.

The inside of a tunnel is lower in air density than the outside, and a convection phenomenon does not occur normally, so that air, pollution inside a tunnel is severe.

As a result of investing air pollution inside a tunnel, it turns out that air pollution inside a tunnel is so severe that impurities such as tiny dust (PM10), carbon dioxide, and volatile organic chemicals exceed maximum five times of a reference value. In particular, in case of tiny dust (PM10), about 139 μl/m is detected, which is much higher than the other noxious substances.

Tiny dust means dust having an aerodynamic diameter of less than 10 μm and causes a serious problem to a human body when continuously inhaling them.

Also, air pollution and impurities inside a tunnel makes it difficult for a driver to secure a visual field and to keep a safe following distance, leading to the high incidence of accidents and causing respiratory illness to a driver's respiratory organ.

Polluted air inside a tunnel is exhausted to a residential district around a tunnel to pollute crops or soil, thereby causing huge damage.

In order to prevent air inside a tunnel from being polluted, it is necessary to install a dust collecting means in a tunnel to clean air to be exhausted from a tunnel.

However, as shown in FIG. 1, a high speed tunnel fan 20 is installed in a tunnel to drive air inside a tunnel to be exhausted to the outside of a tunnel, but there is no method for cleaning air to be exhausted from the high speed tunnel fan 20.

As a dust collecting means, an electrostatic precipitating means with a relatively simple structure and high dust collecting efficiency may be attached to a high speed tunnel fan, but there occur several problems in using the existing electrostatic precipitating means.

Firstly, in case of gas which passes through the electrostatic precipitating means at a high speed, whenever an air flow rate is increased by 1 m/s at a limit air flow rate of the electrostatic precipitating means, dust collecting efficiency is lowered by about 5~10%, whereby dust collecting efficiency is low.

Secondly, a charging portion of the electrostatic precipitating means typically uses a wire method or a saw method, but since a reaction structure area is small when gas flows at a high speed, there is a restriction to charging polluted dust or particles, whereby it can not keep dust collecting efficiency high.

Lastly, a collecting portion for collecting dust or particles is made of alternate plate or stainless plate, but alternate plate or stainless plate has a restriction to collecting and storing polluted dust or particles, do not have constant distribution in generating an electrostatic induction voltage, and has low efficiency since power consumption is high due to an inefficient voltage use.

Therefore, in order to collect polluted dust or particles by using a collecting portion of a plate type, a large number of plate structures are required.

For these reasons, it is impossible to attach the electrostatic precipitating means to the high speed tunnel fan.

DISCLOSURE OF INVENTION

It is an object of the present invention to provide a high speed tunnel fan with an electrostatic filter in which soot and smoke, polluted particles, and tiny dust inside a tunnel are collected to clean air inside a tunnel and high dust collecting efficiency is achieved even at a high air flow rate of more than 10 m/s, (e.g., about 15 m/s to 30 m/s).

It is another object of the present invention to provide a high speed tunnel fan with an electrostatic filter for momentarily removing toxic soot and smoke to reduce victims.

One aspect of the present invention provides a tunnel fan with an electrostatic filter, comprising: a cylindrical shaped tunnel fan; and an electrostatic filter including a pipe assembly, the pipe assembly including a plurality of pipes arranged in parallel to form a cylindrical shape, each pipe having an electrostatic induction means for causing tiny dust to be collected by an induction voltage, wherein the electrostatic filter is coupled to a front or a rear of the tunnel fan.

The electrostatic induction means includes a plurality of rotating projection plates inserted in the plurality of pipes, each of the rotating projection plates having a plurality of projections formed on both sides thereof, wherein the rotating projection plate is formed in a twisted form.

The electrostatic filter further comprises a power supplying support arranged in a front and a rear of the pipe assembly, coupled to the rotating projection plates and electrically connected to an external power supplying means.

The electrostatic filter further comprises a housing for accommodating the pipe assembly and having an insulating mold formed on an inner wall thereof for electrically insulating the pipe assembly.

The pipe has a hexagonal cross section.

The electrostatic filter further comprises a fixing ring fitted into the pipe assembly to fix the power supplying means, wherein the tunnel fan is coupled to the pipe assembly through the fixing ring.

The power supplying support comprises a horizontal support and a vertical support which are arranged in a lattice form.

The pipe has a plurality of grooves formed on an inner wall thereof in a longitudinal direction.

The electrostatic filter further comprises an assembly finishing means for finishing the pipe assembly.

The assembly finishing means is made of a noncombustible silicon-based material.

The width of the rotating projection plate is a third (⅓) to a second (½) of the diameter of the hexagonal pipe, and the height of the projection is a tenth (1/10) to an eighth (⅛) of the diameter of the hexagonal pipe.

The power supplying support further comprises a tension adjusting means for fastening or releasing the horizontal support coupled to the rotating projection plate to adjust tension of the rotating projection plate.

Another aspect of the present invention provides a tunnel fan with an electrostatic filter, comprising: a tunnel fan for driving air to the outside of a tunnel; and an electrostatic filter coupled to the tunnel fan, wherein the electrostatic filter comprising: a pipe assembly including a plurality of pipes arranged in parallel and a plurality of rotating projection plates inserted in the plurality of pipes, each of the rotating projection plates having a plurality of projections formed on both sides thereof, wherein the rotating projection plate is formed in a twisted form; a power supplying support arranged in a front and a rear of the pipe assembly, coupled to the rotating projection plates and electrically connected to an external power supplying means; a housing for accommodating the pipe assembly and having an insulating mold formed on an inner wall thereof for electrically insulating the pipe assembly; and a fixing ring fitted into the pipe assembly to fix the power supplying means, wherein the tunnel fan and the electrostatic filter are coupled through the tunnel fan.

* Description of Major Symbol in the above Figures

| | |
|---|---|
| 1: High speed tunnel fan | 2: Electrostatic filter |
| 10: Hexagonal pipe assembly | 20: Rotating projection plate |
| 22: Projection | 24: Connecting portion |
| 30: Power supplying support | 32: Horizontal support |
| 34: Vertical support | 36: Tension adjusting means |
| 40: Housing | 42: Power connecting portion |
| 44: Fixing means | 50: High voltage supplying means |
| 60: Assembly finishing means | 70: Fixing ring |
| 80: Insulating mold | |

BEST MODE FOR CARRYING OUT THE INVENTION

Hereinafter, exemplary embodiments of the present invention will be described in detail. However, the present invention is not limited to the exemplary embodiments disclosed below, but can be implemented in various types. Therefore, the present exemplary embodiments are provided for complete disclosure of the present invention and to fully inform the scope of the present invention to those ordinarily skilled in the art.

Figure 1:
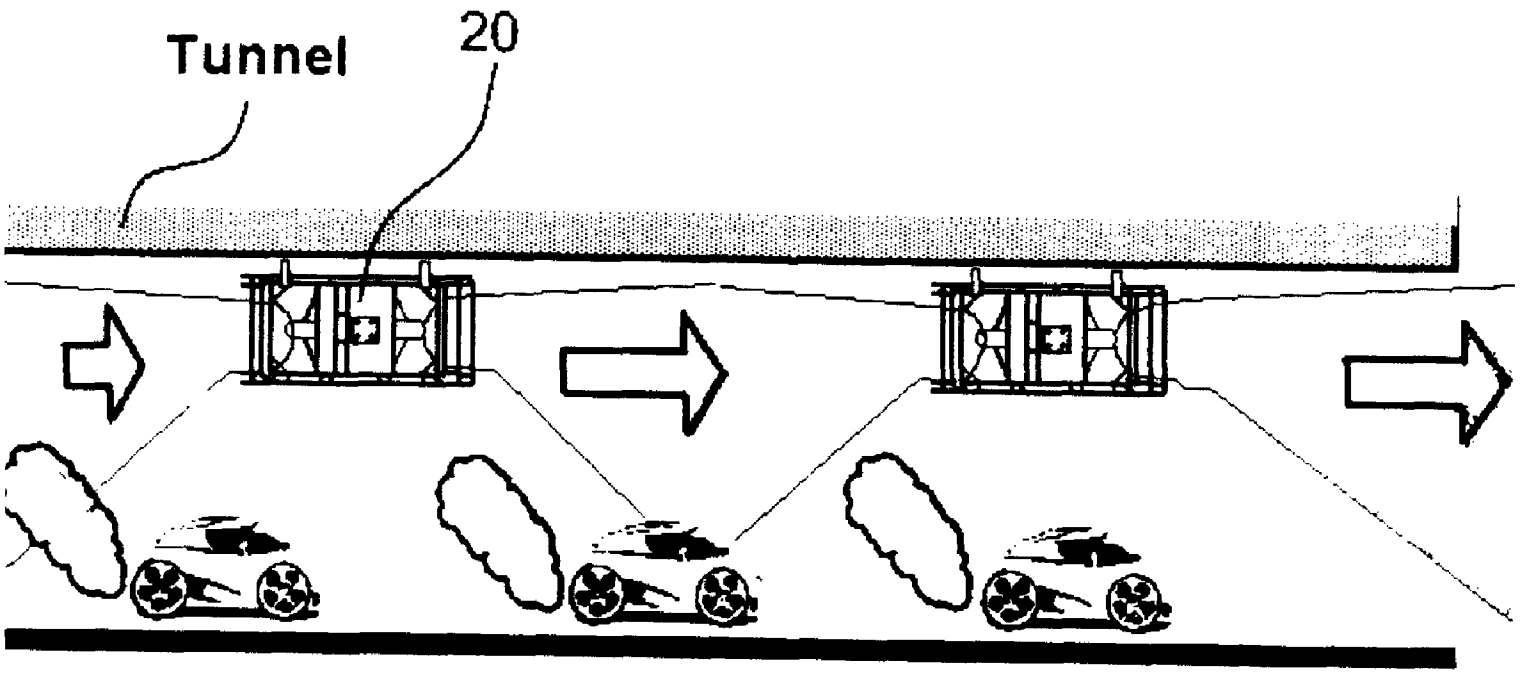
FIG. 1 (PRIOR ART)
FIG. 1 shows a conventional high speed tunnel fan.
Figure 2A:
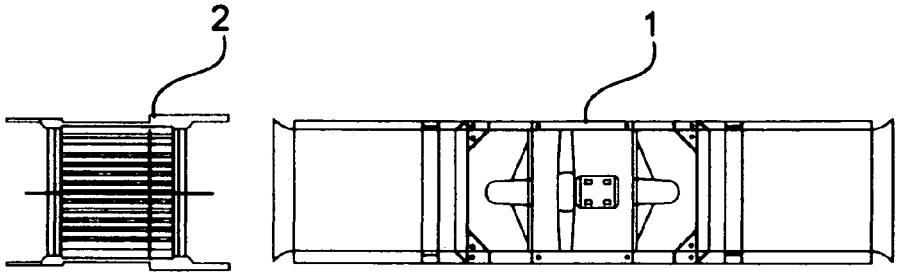
FIGS. 2(*a*)-2(*c*) show a high speed tunnel fan with an electrostatic filter according to an exemplary embodiment of the present invention.
Figure 2B:
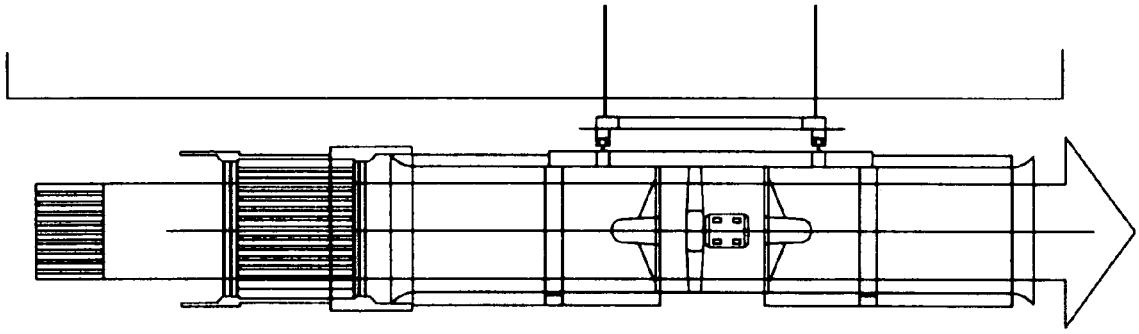
Figure 2C:
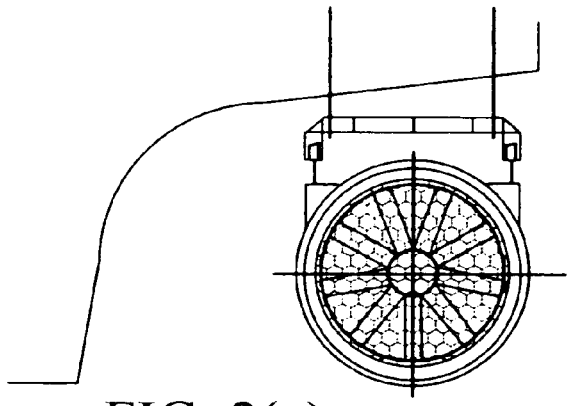

FIG. 2 shows a high speed tunnel fan with an electrostatic filter according to an exemplary embodiment of the present invention. As shown in FIG. 2(*a*), the high speed tunnel fan 1 includes an electrostatic filter 2 coupled or attached to a front or a rear thereof such that the high speed tunnel fan 1 and the electrostatic filter 2 are located in a line.

Since the high speed tunnel fan 1 and the electrostatic filter 2 are coupled in a line, air inside a tunnel passes through the high speed tunnel fan 1 and the electrostatic filter 2 without changing its flow direction, as shown in FIG. 2(*b*). That is, as shown in FIG. 2(*c*), a plurality of hexagonal pipes in the electrostatic filter 2 are located in a line with the high speed tunnel fan 1, so that it is possible to collect dust or particles without disturbing an air flow.

The high speed tunnel fan 1 with electrostatic filter 2 of such a structure collects soot and smoke, contaminants, and tiny dust or particles of less than 10 μm in air which flows at an air flow rate of more than 10 m/s, cleaning polluted air inside a tunnel.

Hereinafter, the electrostatic filter 2 coupled to the high speed tunnel fan 1 according to the exemplary embodiment of the present invention is described in more detail with reference to FIGS. 3 to 11.

The electrostatic filter 2 comprises a hexagonal pipe assembly 10, a rotating projection plate 20, a power supplying support 30, a housing 40, and a high voltage supplying means 50.

The hexagonal pipe assembly 10 comprises a plurality of hexagonal pipes 100 with the predetermined length which are made of aluminum, are electrically grounded, and are arranged in parallel. The hexagonal pipe assembly 10 is arranged in a line with the high speed tunnel fan 1.

The rotating projection plate 20 has a plurality of projections 22 formed on both sides thereof and connecting portions 24 formed on both ends thereof. The rotating projection plate 20 is made of a metal plate longer than the hexagonal pipe 100. The rotating projection plate 20 is formed in a twisted form to provide centrifugal force to targets of collection (e.g., dust or particles) and is inserted into each hexagonal pipe 100 so that it is located in a center of each hexagonal pipe 100.

The power supplying support 30 is located in a front or a rear of the hexagonal pipe assembly 100 and is coupled to the connecting portion 24 of the rotating projection plate 20 exposed outside the hexagonal pipe 100 to thereby fix the rotating projection plate 20. The power supplying support 30 also electrically the rotating projection plate 20 to the high voltage supplying means 50.

The housing 40 has a cylindrical shape whose front and rear are opened to accommodate the hexagonal pipe assembly 10. The housing 40 has a fixing means 70 which is coupled to a front or a rear of an outer case of the high speed tunnel fan 1 in is one-to-one method and an insulating mold which is formed at the predetermined thickness on an inner wall thereof.

The high voltage supplying means 50 is electrically connected to the power supplying support 30 to supply the rotating projection plate 20 with a high voltage.

Figure 3A:
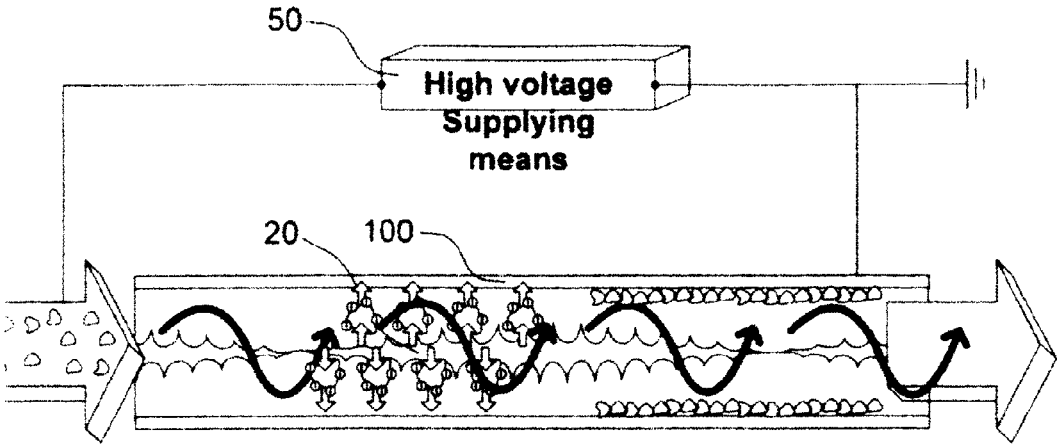
FIGS. 3(*a*)-3(*b*) show one example of a hexagonal pipe to describe a dust collecting principle of the inventive electrostatic filter and a structural feature of the hexagonal pipe according to the exemplary embodiment of the present invention.
Figure 3B:
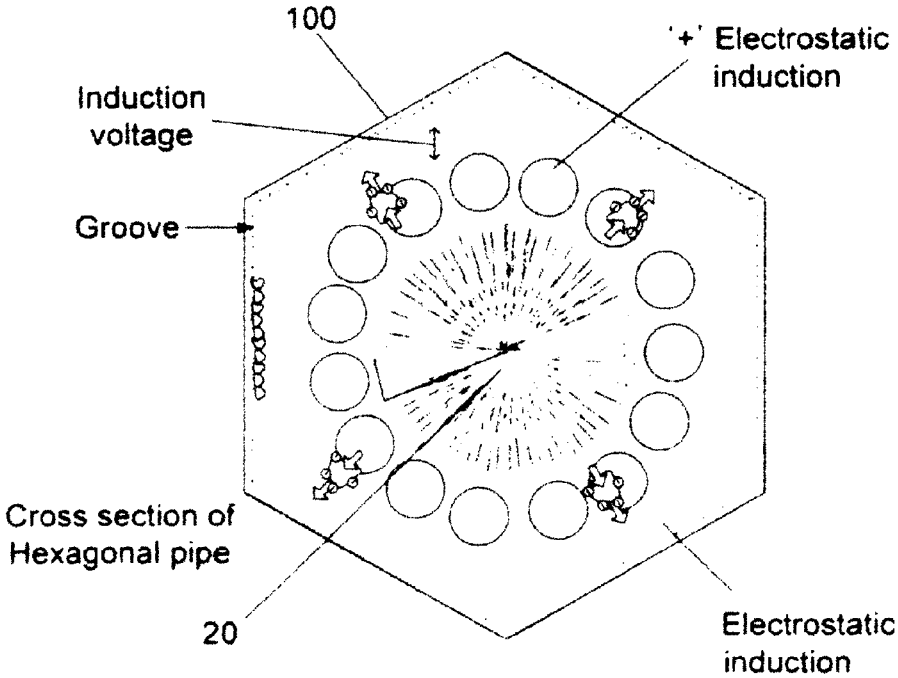

FIG. 3 shows one example of the hexagonal pipe to describe a dust collecting principle of the inventive electrostatic filter and a structural feature of the hexagonal pipe according to the exemplary embodiment of the present invention. The hexagonal pipe 100 is made of a material having an excellent electrical conductive characteristic such as aluminum and has a hexagonal cross section as shown in FIG. 3(*b*).

The hexagonal pipe 100 may have a plurality of grooves formed on an internal surface in a longitudinal direction as shown in FIG. 3(*b*). The groove serves to enlarge an internal surface area of the hexagonal pipe, i.e., collecting surface area, thereby increasing dust collecting efficiency.

The rotating projection plate 20 which is electrically grounded and is twisted is placed in a center of a longitudinal direction of the hexagonal pipe 100.

When a high voltage is applied to the rotating projection plate 20 through the power supplying support 30 from the high voltage supplying means 50, plus (+) electrostatic induction occurs around the rotating projection plate 20, and minus (−) electrostatic induction occurs in an inner wall of a wrinkle-shaped inner wall 100*a* of the hexagonal pipe 100.

In this situation, when air containing tiny dust or particles flows into the hexagonal pipe 100, tiny dust or particles are charged while rotating together with air rotated by the rotating projection plate 20, as shown in FIG. 3(*a*). The charged tiny dust or particles are drawn and stuck to the internal surface, i.e., inner wall 100*a* of the hexagonal pipe 100 by Coulomb's force and centrifugal force, cleaning polluted air inside a tunnel.

The hexagonal pipe 100 and the rotating projection plate 20 of such structures enlarge a portion to be charged. That is, since charging occurs in the whole hexagonal pipe 100, a dust collecting performance is improved. Also, since polluted air is rotated to provide centrifugal force to tiny dust or particles, tiny dust or particles are united, and so it is possible to collect even tiny dust or particles having the diameter of less than 10 μm.

Figure 4A:
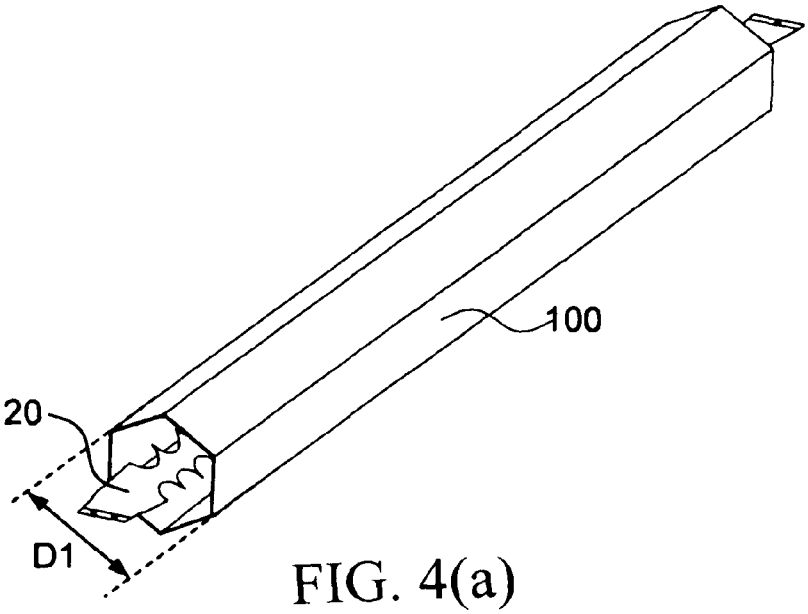
FIGS. 4(*a*)-4(*b*) shows one example of a rotating projection plate according to the exemplary embodiment of the present invention.
Figure 4B:
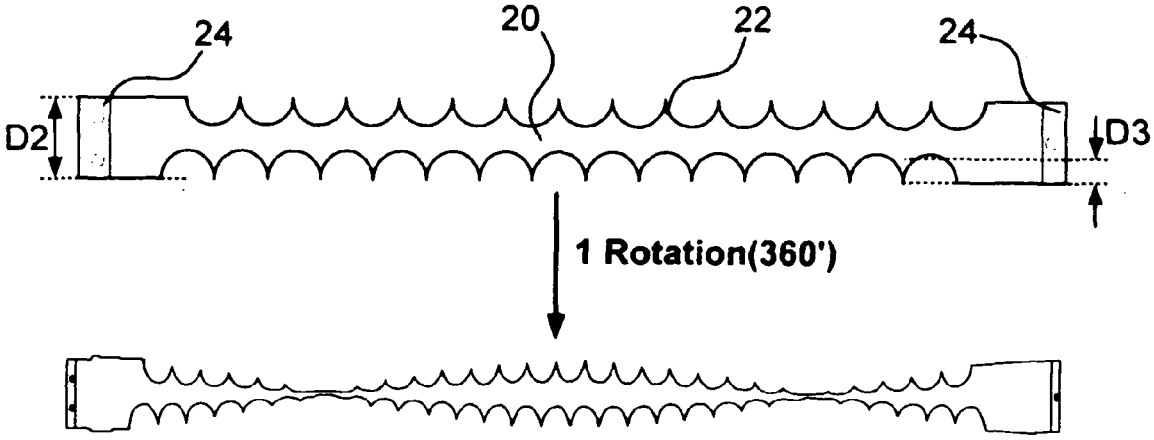

FIG. 4 shows one example of the rotating projection plate according to the exemplary embodiment of the present invention. The rotating projection plate 20 is configured such that the projections 22 are formed on both sides, the connecting portions 24 are formed on both ends, and it is twisted to provide centrifugal force to target of collection. The rotating projection plate 20 is inserted into each hexagonal pipe 100 and is located in a center thereof. At this time, both of the connecting portions 24 are externally exposed outside the hexagonal pipe 100 as shown in FIG. 4(*a*).

The rotating projection plate 20 has a twisted structure with the predetermined width for providing rotation force to flowing air to generate a vortex as shown in FIG. 4(*b*). Preferably, the width D2 of the rotating projection plate 20 is a third (⅓) to a second (½) of the diameter D1 of the hexagonal pipe 100 in order to generate a vortex, and the height D3 of the projection 22 is a tenth (1/10) to an eighth (⅛) of the diameter D1 of the hexagonal pipe 100.

The number of twisting is preferably one rotation (360°), but two or three rotations are possible according to a need.

Figure 5:
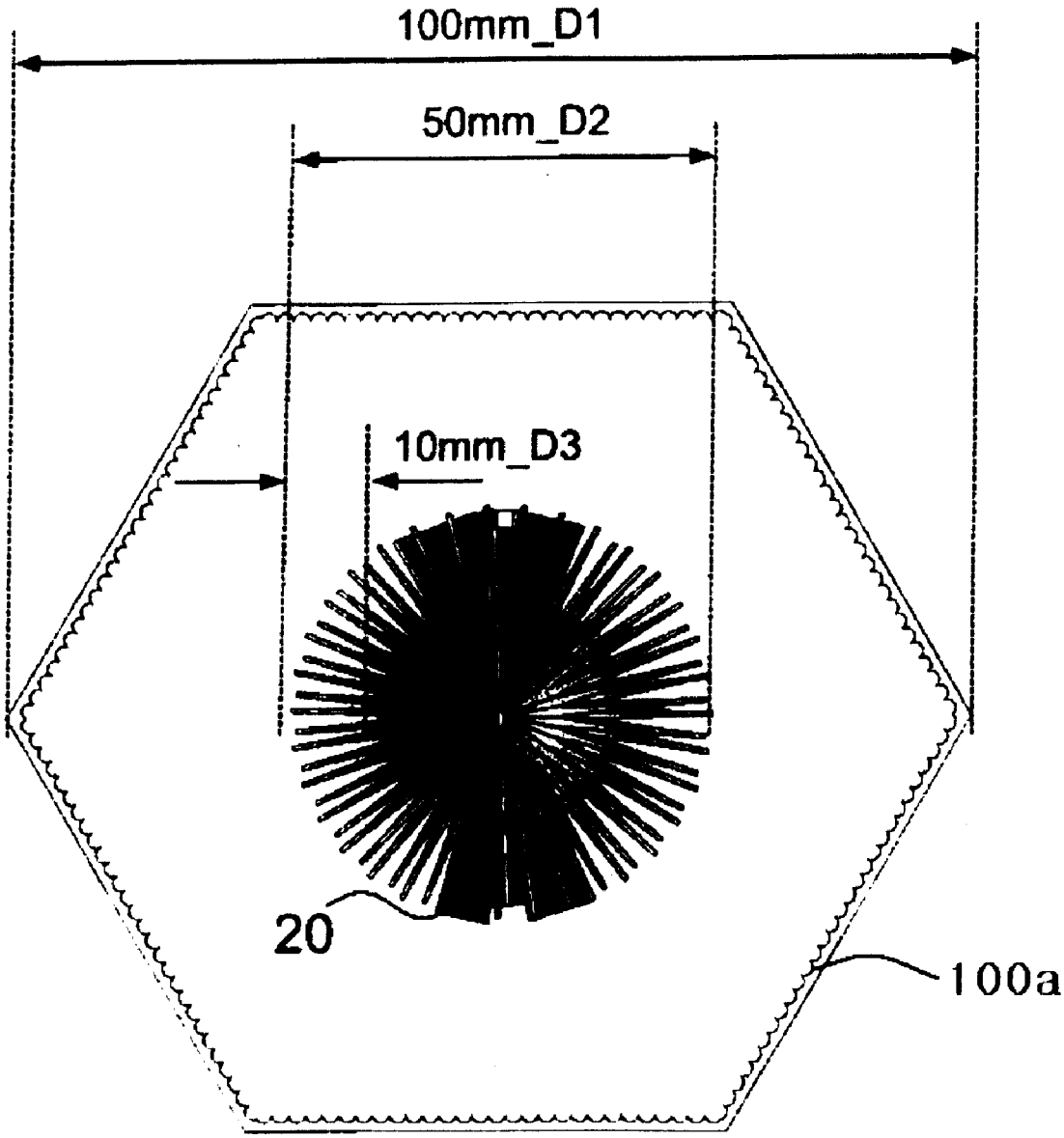
FIG. 5 shows one example of the rotating projection plate according to the exemplary embodiment of the present invention.

FIG. 5 shows one example of the rotating projection plate according to the exemplary embodiment of the present invention. As shown in FIG. 5, if the diameter D1 of the wrinkle-shaped collecting pipe 10 is 100 mm, the width D2 of the rotating projection plate 20 is 50 mm, and the height D3 of the projection 22 is 10 mm.

Therefore, a rotating surface is formed at the width of 30 mm along the hexagonal pipe 10, and air passing through the hexagonal pipe 10 is rotated by the rotating surface, so that tiny dust or particles contained in the rotating air is rotated together.

Figure 6:
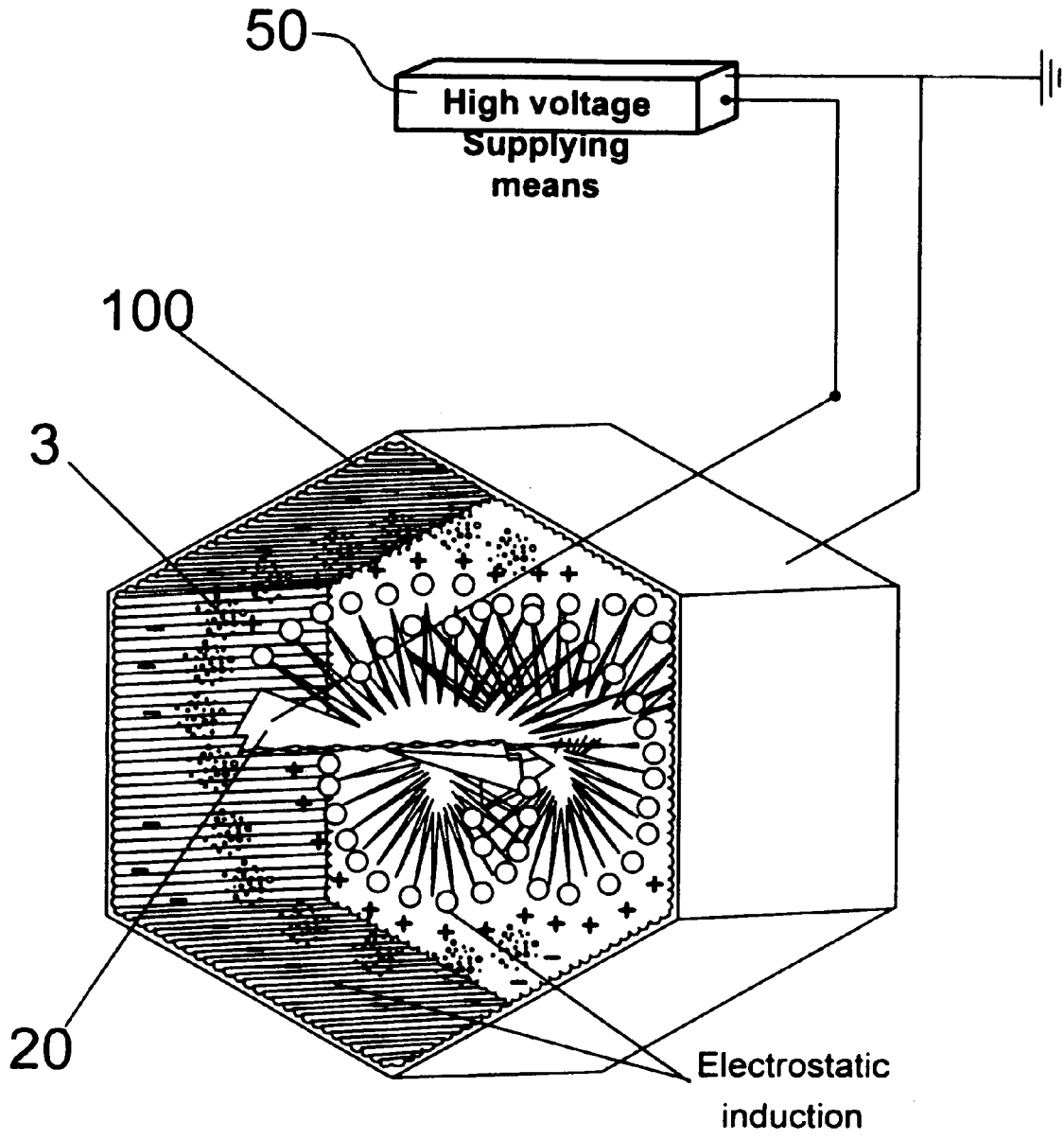
FIG. 6 shows a role of the rotating projection plate according to the exemplary embodiment of the present invention.

FIG. 6 shows a role of the rotating projection plate according to the exemplary embodiment of the present invention. As shown in FIG. 6, since the rotating projection plate 20 in the grounded hexagonal pipe 100 is electrically connected to the high voltage supplying means 50 and is placed in a center of a longitudinal direction, when a high voltage is applied from the high voltage supplying means 50, plus electrostatic induction occurs along the rotating projections 22 around the rotating projection plate 20, and minus electrostatic induction occurs in the internal sidewall of the hexagonal pipe 10 by the induction voltage.

Therefore, air flowing into the hexagonal pipe 100 is rotated along the rotating projection plate 20, and tiny dust or particles 3 contained in the rotating air is rotated together, and collected and stuck to the inner wall of the hexagonal pipe 100 by Coulomb's force and centrifugal force.

Figure 7A:
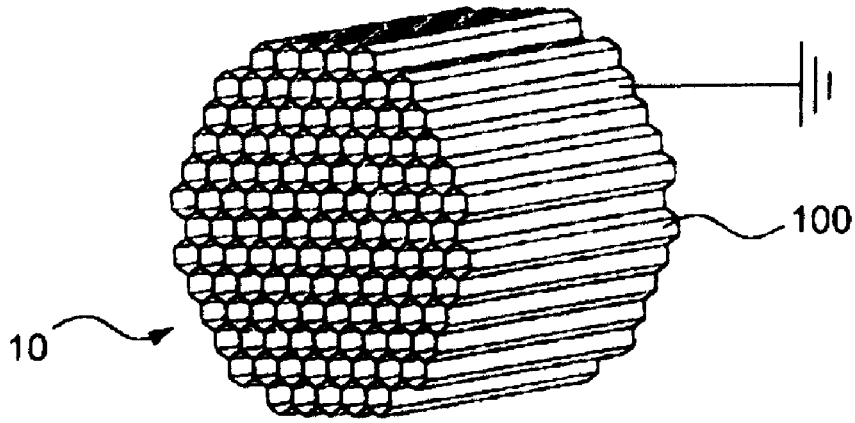
FIGS. 7(*a*)-7(*b*) show an assembly structure of the hexagonal pipe assembly, the rotating projection plate and the power supplying support according to the exemplary embodiment of the present invention.
Figure 7B:
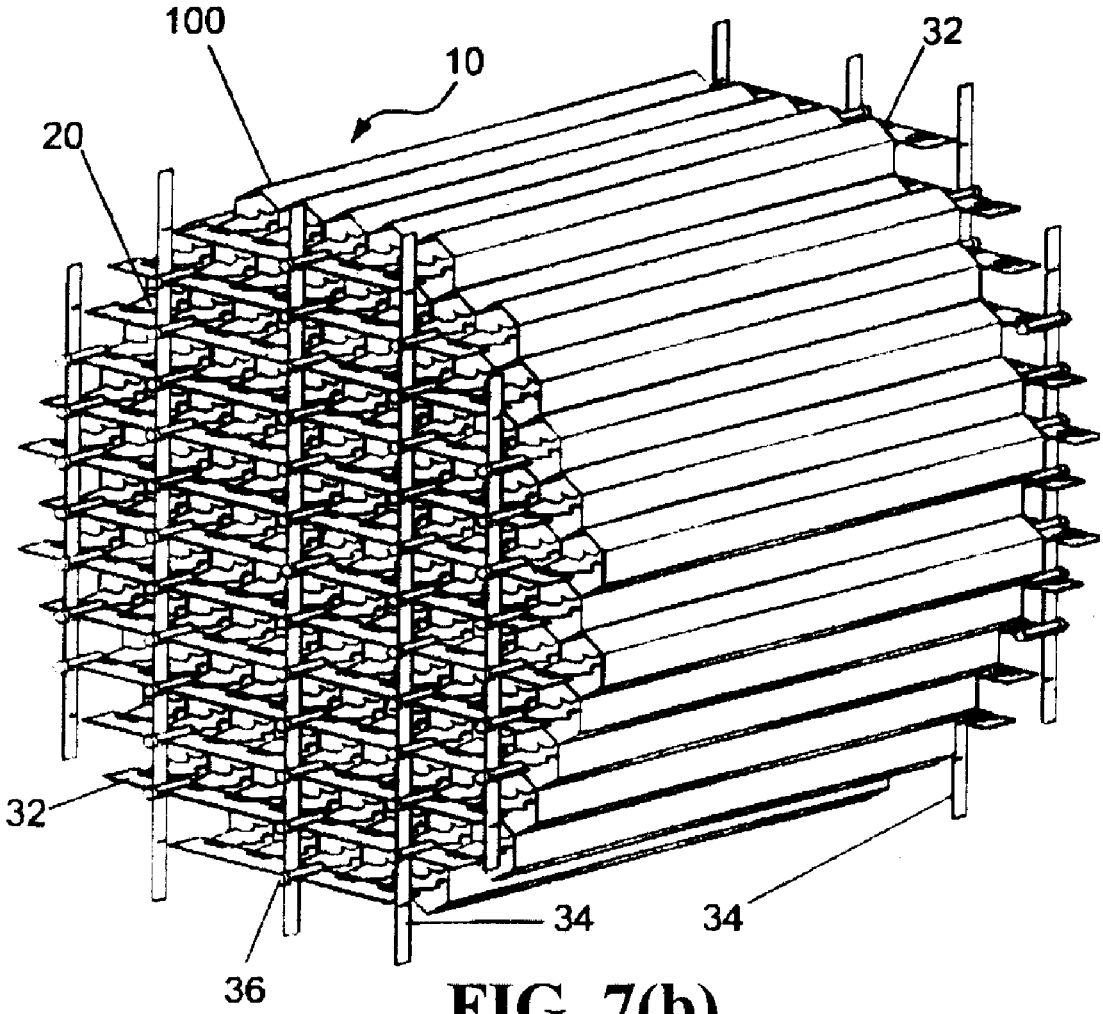

FIG. 7 shows an assembly structure of the hexagonal pipe assembly, the rotating projection plate and the power supplying support according to the exemplary embodiment of the present invention.

As shown in FIG. 7(*a*), the hexagonal assembly 10 is configured such that a plurality of hexagonal pipes 100 are arranged in parallel to form a cylindrical shape.

Figure 8A:
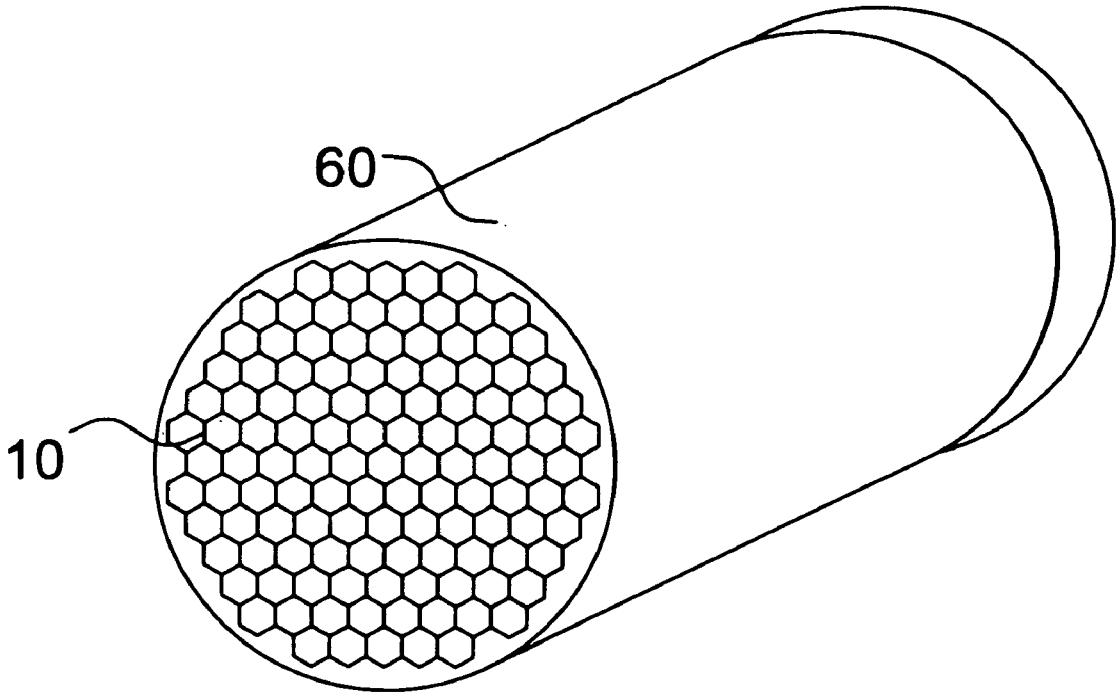
FIG. 8(*a*)-8(*b*) show an assembly finishing means of the electrostatic filter according to the exemplary embodiment of the present invention.
Figure 8B:
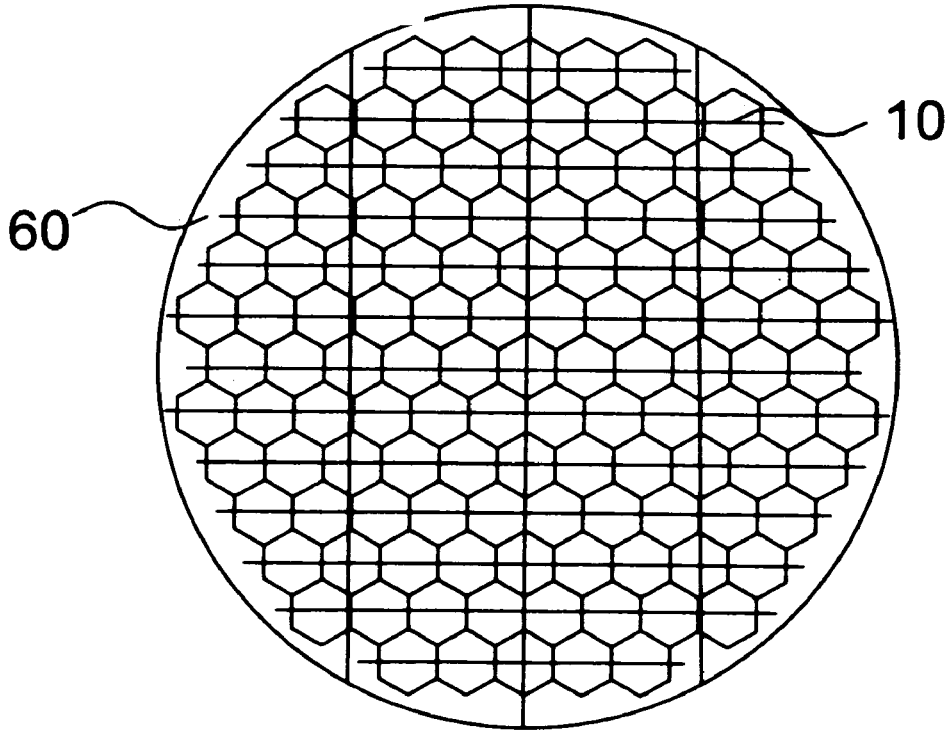

In order to electrically insulating the hexagonal pipe assembly 10 and maintain the assembly state thereof, as shown in FIG. 8, the hexagonal pipe assembly 10 is finished at the predetermined thickness by an assembly finishing means 60. Preferably, a noncombustible silicon-based material is used as the assembly finishing means 60.

That is, as shown in FIG. 8(*a*), the assembly finishing means 60 surrounds the whole external surface of the hexagonal pipe assembly 10. The assembly finishing material 60 serves to externally insulate the hexagonal pipe assembly 10 while fixing the hexagonal pipes 10 to maintain the assembly state thereof, as shown in FIG. 8(*b*).

Figure 9:
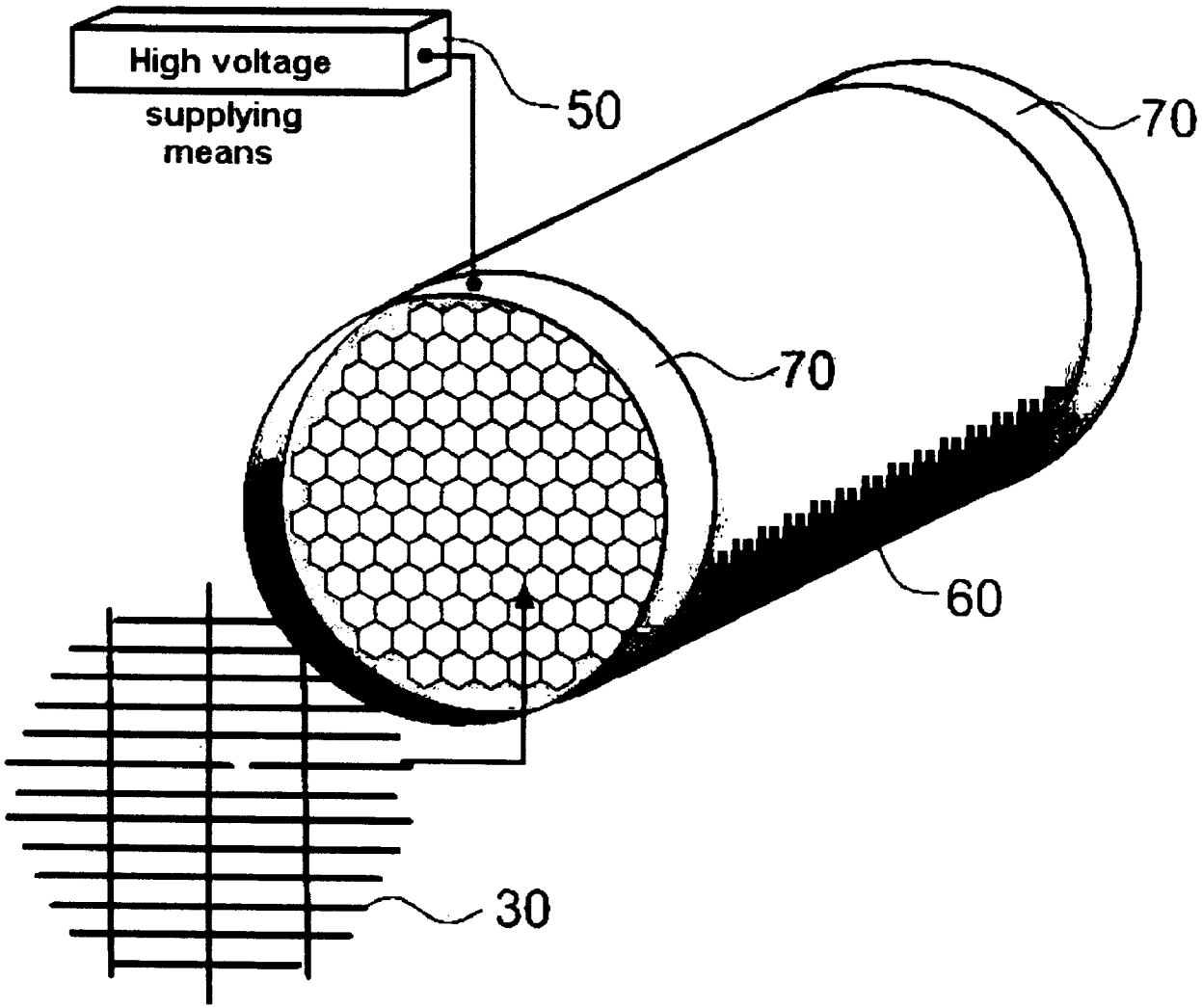
FIG. 9 shows a fixing ring of the electrostatic filer according to the exemplary embodiment of the present invention.

FIG. 9 shows a fixing ring of the electrostatic filer according to the exemplary embodiment of the present invention. A fixing ring 70 is fitted into a front and a rear of the hexagonal pipe assembly 10 finished by the assembly finishing means 60. The fixing ring 70 protrudes by a predetermined length, is coupled to the power supplying support 30 and is electrically connected to the high voltage supplying means 50.

Thanks to the fixing ring 70, the power supplying support 30 for fixing the rotating projection plate 20 is fixed and is electrically connected to the high voltage supplying means 50.

Here, since the rotating projection plate 20 is inserted into each hexagonal pipe 100, the number of the rotating projection plates 20 is substantially identical to the number of the hexagonal pipes 100, as shown in FIG. 7(*b*).

As described above, the rotating projection plate 20 is fixed such that it is coupled to the fixing ring 70 fitted into the front and rear of the hexagonal pipe assembly 10 and is coupled to the power supplying support 30 electrically connected to the high voltage supplying means 50 through the fixing ring 70. Therefore, the rotating projection plate 20 is supplied with charges by a direct current (DC) voltage of more than 11,000 volts.

The power supplying support 30 may be realized in various forms. For example, as shown in FIG. 7(*b*), the power supplying support 30 comprises a horizontal support 32 and a vertical support 34. Any of the horizontal support 32 and the vertical support 34 is electrically connected to the high voltage supplying means 50. The horizontal support 32 and the vertical support 34 are coupled to each other by a tension adjusting means 36 for adjusting tension of the rotating projection plate 20.

The tension adjusting means 36 may have a structure for fastening or releasing the horizontal support 32 coupled to the rotating projection plate 20 to adjust tension of the rotating projection plate 20 as shown in FIG. 7(*b*).

Figure 10:
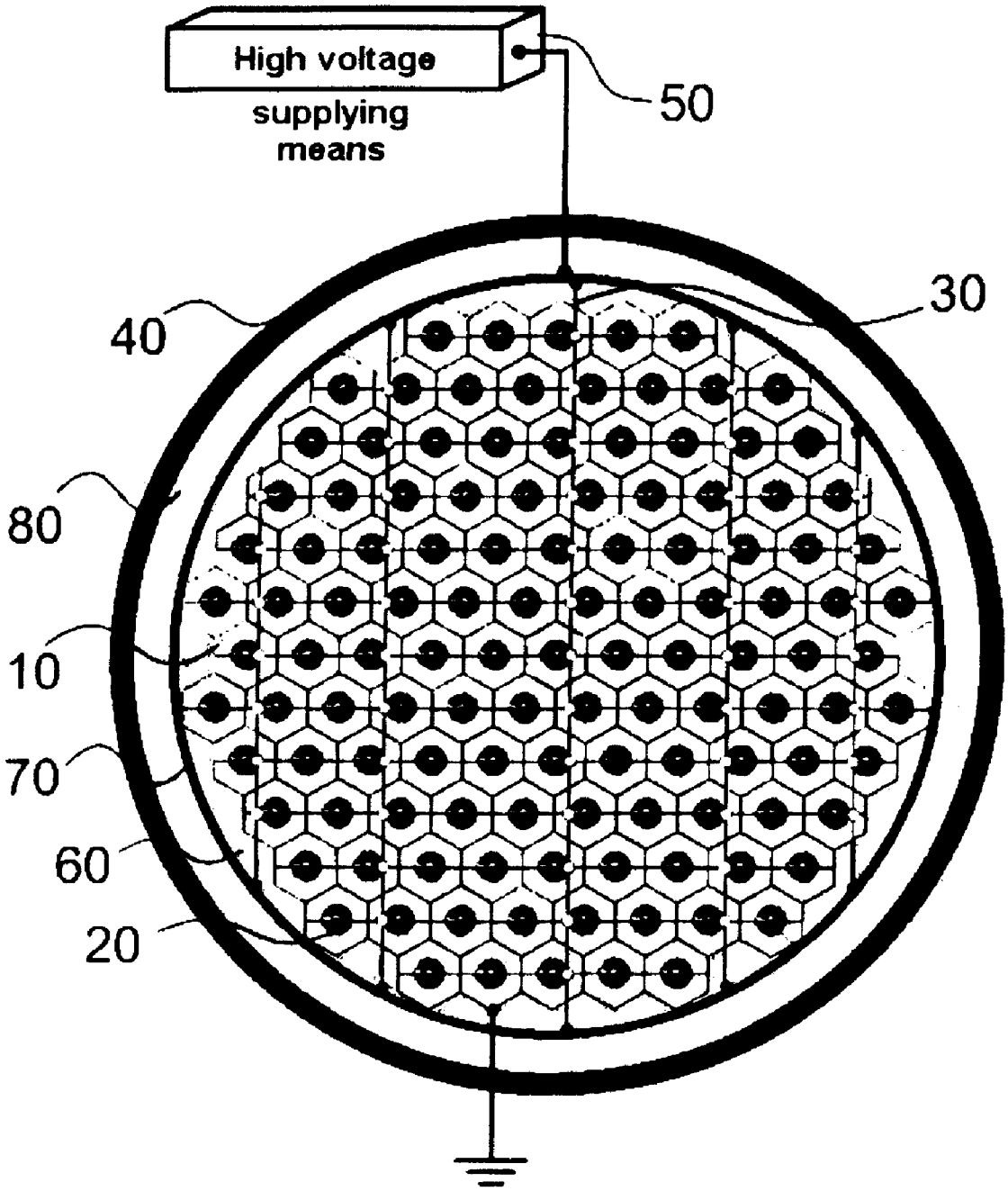
FIG. 10 shows one example of the housing according to the exemplary embodiment of the present invention.

FIG. 10 shows one example of the housing according to the exemplary embodiment of the present invention.

The hexagonal pipe assembly 10 which is finished by the assembly finishing means 60 and the fixing ring is fitted into is inserted into the housing 40 which has an insulating mold 80 formed on an inner wall thereof.

The insulating mold 80 is made of synthetic resin for electrically insulating the electrostatic filter from a high voltage. The insulating mold 80 serves as a frame of the housing.

In summary, the electrostatic filter 2 of the present invention is configured such that a plurality of hexagonal pipes 10 are assembled to form the hexagonal pipe assembly 10, the hexagonal pipe assembly 10 is finished by the assembly finishing means 60, the fixing ring is fitted into the front and rear of the hexagonal pipe assembly 10, and such a hexagonal pipe assembly 10 is accommodated by the housing 40.

The rotating projection plate 20 is inserted into each hexagonal pipe 100 and is coupled to the power supplying support 30 coupled to the fixing ring 70. Such a hexagonal pipe assembly 10 is accommodated by the housing 40 having the insulating mold 80 formed on the inner wall thereof.

The hexagonal pipe assembly 10 is electrically grounded, and the fixing ring 70 is electrically connected to the high voltage supplying means 50.

Figure 11:
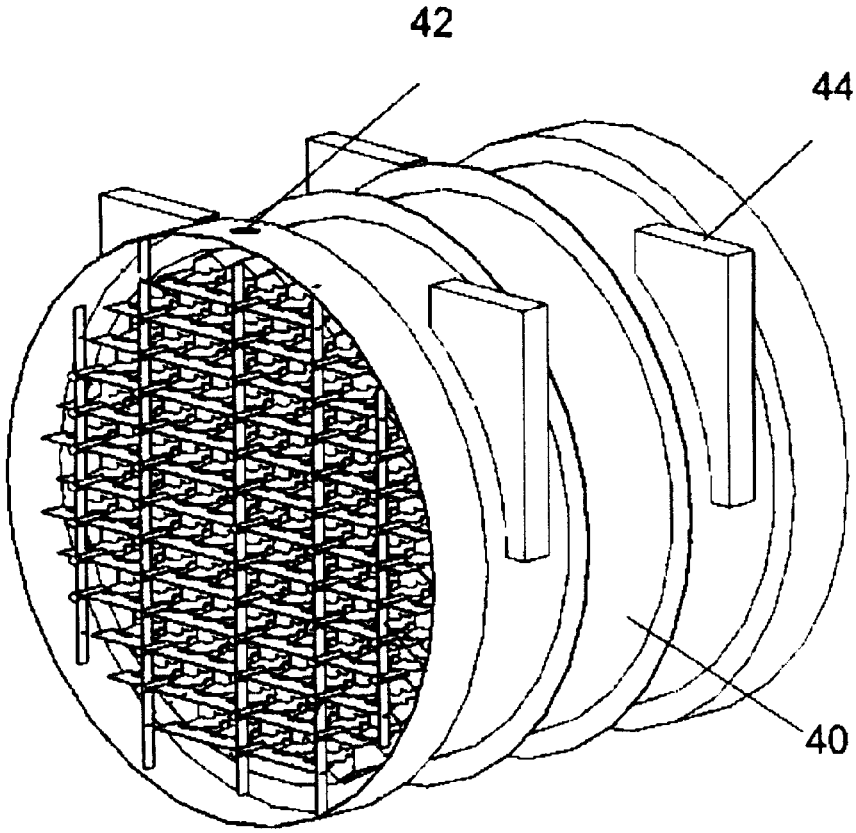
FIG. 11 shows the electrostatic filter according to the exemplary embodiment of the present invention.

FIG. 11 shows the electrostatic filter according to the exemplary embodiment of the present invention. As shown in FIG. 11, the housing 40 may further comprise a power connecting portion 42 connected to the high voltage supplying means 50 and a fixing means 44 for fixing the electrostatic filter to a tunnel's ceiling.

Even though not shown in detail, the housing 10 is coupled to the outer case of the high speed tunnel fan 1 in one-to one method, and the coupled portion is preferably shut tightly. Preferably, the housing 40 is attachably coupled to the high speed tunnel fan 1.

The high speed tunnel fan with the electrostatic filter for the high speed tunnel fan according to the present invention has the following advantages. It is possible to collect tiny dust or particles in polluted air which flows even at a high air flow rate of more than 10 m/s (e.g., 15 m/s to 30 m/s). Tiny dust or particles are united by a vortex occurred in each hexagonal pipe and are collected by centrifugal force, whereby a particle collecting performance is improved. As a result, polluted air which is driven by the high speed tunnel fan and exhausted outside a tunnel is cleaned, thereby preventing the surroundings of a tunnel from being polluted.

In addition, the dust collecting area is increased in the same number of the hexagonal pipes, whereby the dust collecting performance, the amount of collected dust, and the dust collecting efficiency are improved.

The invention claimed is:

1. A tunnel fan with an electrostatic filter, comprising:

a cylindrical shaped tunnel fan; and an electrostatic filter including a pipe assembly, the pipe assembly including a plurality of pipes arranged in parallel to form a cylindrical shape, each pipe having an electrostatic induction means for causing tiny dust to be collected by an induction voltage, the electrostatic induction means including a plurality of rotating projection plates inserted in the plurality of pipes, each of the rotating projection plates being formed in a twisted form and having a plurality of projections formed on both sides thereof;

wherein the electrostatic filter is coupled to a front or a rear of the tunnel fan.

2. The tunnel fan of claim 1, wherein the electrostatic filter further comprises a power supplying support arranged in a front and a rear of the pipe assembly, coupled to the rotating projection plates and electrically connected to an external power supplying means.

3. The tunnel fan of claim 1, wherein the electrostatic filter further comprises a housing for accommodating the pipe assembly and having an insulating mold formed on an inner wall thereof for electrically insulating the pipe assembly.

4. The tunnel fan of claim 1, wherein the pipe has a hexagonal cross section.

5. The tunnel fan of claim 2, wherein the electrostatic filter further comprises a fixing ring fitted into the pipe assembly to fix the power supplying means, wherein the tunnel fan is coupled to the pipe assembly through the fixing ring.

6. The tunnel fan of claim 2, wherein the power supplying support comprises a horizontal support and a vertical support which are arranged in a lattice form.

7. The tunnel fan of claim 1, wherein the pipe has a plurality of grooves formed on an inner wall thereof in a longitudinal direction.

8. The tunnel fan of claim 1, wherein the electrostatic filter further comprises an assembly finishing means for finishing the pipe assembly.

9. The tunnel fan of claim 8, wherein the assembly finishing means is made of a noncombustible silicon-based material.

10. The tunnel fan of claim 4, wherein the width of the rotating projection plate is a third (⅓) to a half (½) of the diameter of the hexagonal pipe, and the height of the projection plate is a tenth (1/10) to an eighth (⅛) of the diameter of the hexagonal pipe.

11. The tunnel fan of claim 6, wherein the power supplying support further comprises a tension adjusting means for fastening or releasing the horizontal support coupled to the rotating projection plate to adjust tension of the rotating projection plate.

12. A tunnel fan with an electrostatic filter, comprising:

a tunnel fan for driving air to the outside of a tunnel; and an electrostatic filter coupled to the tunnel fan, wherein the electrostatic filter comprising:

a pipe assembly including a plurality of pipes arranged in parallel and a plurality of rotating projection plates inserted in the plurality of pipes, each of the rotating projection plates having a plurality of projections formed on both sides thereof, wherein the rotating projection plate is formed in a twisted form;

a power supplying support arranged in a front and a rear of the pipe assembly, coupled to the rotating projection plates and electrically connected to an external power supplying means;

a housing for accommodating the pipe assembly and having an insulating mold formed on an inner wall thereof for electrically insulating the pipe assembly; and a fixing ring fitted into the pipe assembly to fix the power supplying means, wherein the tunnel fan and the electrostatic filter are coupled through the tunnel fan.

13. The tunnel fan of claim 12, wherein the pipe has a hexagonal cross section.

14. The tunnel fan of claim 12, wherein the power supplying support comprises a horizontal support and a vertical support which are arranged in a lattice form.

15. The tunnel fan of claim 12, wherein the pipe has a plurality of grooves formed on an inner wall thereof in a longitudinal direction.

16. The tunnel fan of claim 12, wherein the electrostatic filter further comprises an assembly finishing means for finishing the pipe assembly.

17. The tunnel fan of claim 16, wherein the assembly finishing means is made of a noncombustible silicon-based material.

18. The tunnel fan of claim 12, wherein the width of the rotating projection plate is a third (⅓) to a half (½) of the diameter of the hexagonal pipe, and the height of the projection plate is a tenth (1/10) to an eighth (⅛) of the diameter of the hexagonal pipe.

19. The tunnel fan of claim 14, wherein the power supplying support further comprises a tension adjusting means for fastening or releasing the horizontal support coupled to the rotating projection plate to adjust tension of the rotating projection plate.

* * * * *